US006769632B2

(12) United States Patent
Takeuchi

(10) Patent No.: US 6,769,632 B2
(45) Date of Patent: Aug. 3, 2004

(54) METHOD AND APPARATUS FOR SUPPLYING COATING MATERIAL

(75) Inventor: Tohru Takeuchi, Yokohama (JP)

(73) Assignee: Kansai Paint Co., Ltd., Hyogo-ken (JP)

( * ) Notice: Subject to any disclaimer, the term of this patent is extended or adjusted under 35 U.S.C. 154(b) by 0 days.

(21) Appl. No.: 10/280,310

(22) Filed: Oct. 23, 2002

(65) Prior Publication Data

US 2003/0080211 A1 May 1, 2003

(30) Foreign Application Priority Data

Oct. 25, 2001 (JP) ..... 2001-327051

(51) Int. Cl.[7] ..... B05B 7/12

(52) U.S. Cl. ..... 239/412; 239/320; 239/322; 239/329; 239/411; 222/145.5; 222/386

(58) Field of Search ..... 239/320, 321, 239/322, 329, 331, 332, 333, 398, 411, 412; 222/145.5, 145.6, 326, 389, 386; 427/421, 426

(56) References Cited

U.S. PATENT DOCUMENTS 4,790,454 A * 12/1988 Clark et al. ..... 239/332
4,881,821 A * 11/1989 Stutz ..... 222/145.6
5,092,492 A * 3/1992 Centea ..... 222/145.6
5,634,571 A * 6/1997 Cataneo et al. ..... 222/389
5,882,735 A 3/1999 Takeuchi ..... 427/430.1
6,105,822 A * 8/2000 Larsen et al. ..... 222/145.6
6,383,572 B1 * 5/2002 De Graaf et al. ..... 427/421

FOREIGN PATENT DOCUMENTS

JP 06-294379 10/1994

* cited by examiner

*Primary Examiner*—Tu Minh Nguyen
(74) *Attorney, Agent, or Firm*—Knobbe Martens Olson & Bear LLP

(57) ABSTRACT

An apparatus for supplying a coating material, including: a coating material tank (2) for storing a high-viscosity coating material; a solvent tank (6) for storing a dilution solvent; a mixing machine (11) for mixing the high-viscosity coating material and the dilution solvent; a metering pump (5) for supplying the high-viscosity coating material from the coating material tank (2) to the mixing machine (11); and a solvent pump (9) for supplying the dilution solvent from the solvent tank (6) to the mixing machine (11), wherein the coating material tank (2) is a pressure tank which allows the high-viscosity coating material to be fed under the pressure of compressed air and the metering pump (5) supplies the high-viscosity coating material fed from the coating material tank (2) under the pressure of compressed air to the mixing machine (11) while quantifying the flow rate of the same.

7 Claims, 2 Drawing Sheets

METHOD AND APPARATUS FOR SUPPLYING COATING MATERIAL

BACKGROUND OF THE INVENTION

1. Field of the Invention

This invention relates to a method and an apparatus for supplying a coating material, in more particular, to a method and an apparatus for supplying a coating material which enable the dilution of a high-viscosity coating material to a suitable viscosity for coating and thereby the application of the same to an object to be coated.

2. Description of the Related Art

There have been known an apparatus for supplying a coating material in which two different types of liquid components are pumped to join each other, then mixed together in a mixing machine, and supplied to a coating machine such as a coating gun, as disclosed in, for example, Japanese Patent Laid-Open No. 6-294379. This apparatus for supplying a coating material is constructed so as to allow a lower-viscosity liquid component, which is inferior in pump efficiency, to be supplied under pressure by adopting a pressure tank as lower-viscosity liquid component supplying means, when the two liquid components have different viscosities, whereby the precision of the mixing ratio of the two liquid components is intended to be heightened.

The use of the above described apparatus for supplying a coating material, however, has given rise to a problem of making it significantly difficult to supply a coating material to a coating machine, depending on the types of coating materials.

For example, when using a high-solids-content coating material having a solids content as high as about 70 to 100%, the coating material is difficult to flow through the piping with an ordinary pump due to its high viscosity, which causes a problem of being unable to mix it with a dilution solvent to dilute it to a desired viscosity.

Therefore, when supplying a high-viscosity coating material which requires dilution, the coating material has been diluted with a dilution solvent to a suitable viscosity for coating in advance within a tank into which the coating material is filled.

However, diluting a coating material in advance within such a tank still gives rise to a problem of being likely to cause solid-liquid separation due to the sedimentation of the pigments and powders of the coating material within the tank as well as within the piping to a coating machine so that the coating material with a desired viscosity cannot be obtained. Furthermore, constantly stirring the coating material in the tank and allowing the coating material to flow through the piping so as to avoid solid-liquid separation also produce a problem of not only increasing running cost, but also causing pigment deformation and changes in particle size distribution, resulting in changes in pigment color with time.

SUMMARY OF THE INVENTION

Accordingly, the object of this invention is to provide a method and an apparatus for supplying a coating material which can ensure supply of a coating material to a coating machine without causing a problem of solid-liquid separation even when using a high-viscosity coating material.

The above described object of this invention is accomplished by a method for supplying a coating material which includes: a step of supplying a high-viscosity coating material from a coating material tank to a mixing machine; a step of supplying a dilution solvent from a solvent tank to the above mixing machine; and a step of mixing the high-viscosity coating material and the dilution solvent in the above mixing machine to supply the mixture to a coating machine, wherein the step of supplying a high-viscosity coating material to a mixing machine includes a step of supplying the high-viscosity coating material fed from the coating material tank under the pressure of compressed air to the above mixing machine while quantifying the flow rate of the same with a metering pump.

The above described object of this invention is accomplished by an apparatus for supplying a coating material which includes: a coating material tank for storing a high-viscosity coating material; a solvent tank for storing a dilution solvent; a mixing machine for mixing the high-viscosity coating material and the dilution solvent; a metering pump for supplying the high-viscosity coating material from the above coating material tank to the above mixing machine; and a solvent pump for supplying the dilution solvent from the above solvent tank to the above mixing machine, wherein the above coating material tank is a pressure tank which allows the high-viscosity coating material to be fed under the pressure of compressed air and the above metering pump supplies the high-viscosity coating material fed from the coating material tank under the pressure of compressed air to the above mixing machine while quantifying the flow rate of the same.

DETAILED DESCRIPTION OF THE PREFERRED EMBODIMENTS

Figure 1:
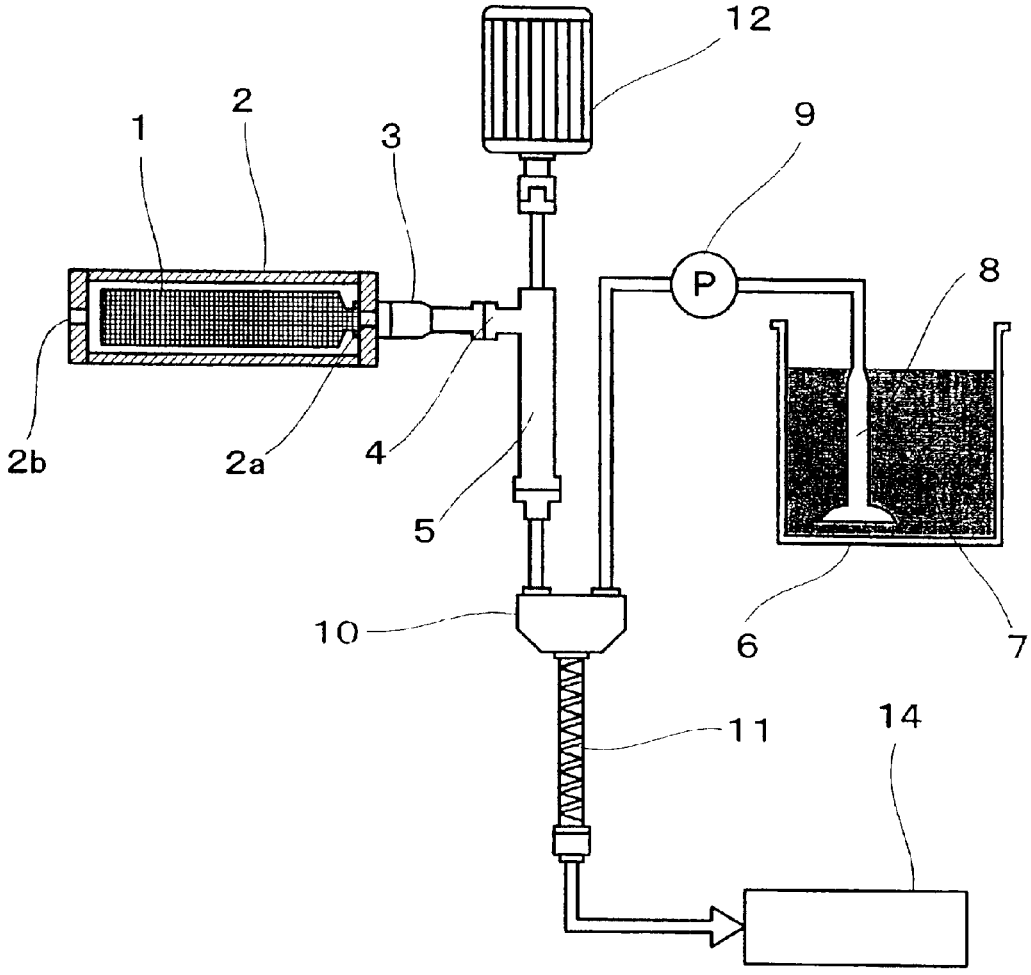
FIG. 1 is a schematic block diagram showing an apparatus for supplying a coating material according to one embodiment of this invention.

In the following the embodiment of this invention will be described with reference to the accompanying drawings. FIG. 1 is a schematic block diagram showing an apparatus for supplying a coating material according to one embodiment of this invention.

As shown in FIG. 1, the apparatus for supplying a coating material includes, as main components, a pressure tank 2, a solvent tank 6 for storing a dilution solvent 7, and a mixing machine 11 for mixing/dispersing the coating material and the dilution solvent.

Although the pressure tank 2 used is not limited as long as it allows a coating material to be fed under the pressure of compressed air, in this embodiment a cartridge type of tank is used. Specifically, the pressure tank 2 is constructed to have a cylindrical coating material tube 1 removably installed in its interior and has a discharge opening 2*a* formed at one of its ends (on the right side in the figure) and an injection opening 2*b* formed at the other end (on the left side in the figure), and the coating material stored in the coating material tube 1 is extruded through the discharge opening 2*a* when compressed air is supplied into the pressure tank 2 through the injection opening 2*b* to shrink the coating material tube 1. Using the above coating material tube extrusion type of tank as a pressure tank can eliminate the need for a cleaning operation within the tank.

Figure 2:
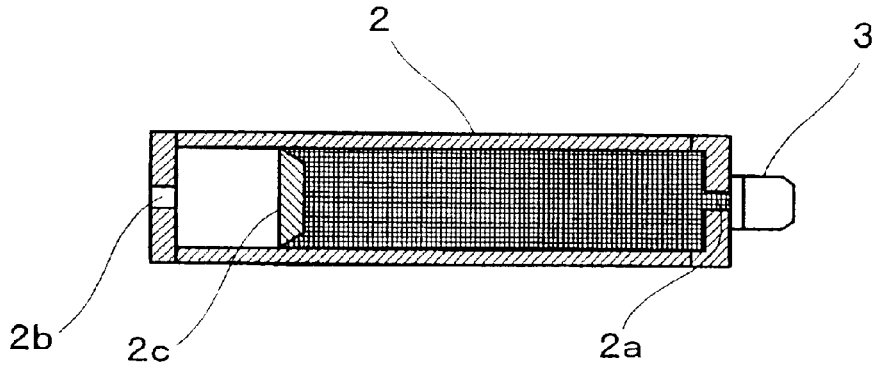
FIG. 2 is a cross-sectional view showing a variation of the pressure tank of the apparatus for supplying a coating material shown in FIG. 1.

The cartridge type of tank may be a piston extrusion type of tank which is a cylindrical pressure tank 2 including a piston 2*c* provided in its interior in a slidable manner, as shown in FIG. 2, and the coating material filled into the pressure tank 2 can be extruded by pressing the piston 2*c* by the action of compressed air.

If the pressure tank 2 is provided with a valve near the discharge opening 2*b* and constructed so that it can seal compressed air in advance, the extrusion of the coating material from the pressure tank 2 may also be carried out by opening the valve, instead of supplying compressed air from the outside through the injection opening 2*b*, as in the case of this embodiment. The pressure tank 2 may also be constructed so that it can have more than one coating material tube 1 installed in its interior and select an appropriate coating material supplied. The coating material tube 1 may be a disposable type of one or may be constructed so that it can be re-filled using a known coating material filing machine. When taking into account changes in color of coating materials, it is preferable to provide a cleaning machine for cleaning the flow path of the coating materials between a suction opening 4 and a discharge opening of a coating machine 14. The cleaning machine is constructed so that it can supply a cleaning thinner and flashing air from the neighborhood of the suction opening 4 toward the coating machine 14, and it can clean the flow path of the coating materials by discharging the cleaning thinner and the flashing air alternately. This cleaning operation allows changing colors to be carried out only by replacing the coating material tube 1 by another one of different color without discarding the coating material.

The discharge opening 2*a* of the pressure tank 2 is connected to the suction opening 4 of a metering pump 5 via a quick joint 3. As in the case of this embodiment, it is preferable the pressure tank 2 and the metering pump 5 are directly connected without intervention of piping or the like.

The metering pump 5 is connected to a manifold 10, and when it is rotationally driven by a driving motor 12, it feeds the coating material supplied under pressure to the manifold 10. The supply of the coating material to the manifold 10 can be quantitatively carried out through controlling the driving motor 12 to adjust the r.p.m. of the metering pump 5.

The metering pumps 5 applicable include, for example, a snake pump, a screw pump, a piston pump and a gear pump, and any one of them can be selected according to, for example, the type of the coating material used. For example, when using a coating material in the form of a powder slurry, it is preferable to use a snake pump, avoiding distortion of pigments.

The solvent tank 6 is connected to the manifold 10 via a strainer 8 and a solvent pump 9. The dilution solvent in the solvent tank 6 is sucked up via the strainer 8 by the actuation of the solvent pump 9 and supplied to the manifold 10. The solvent pumps applicable include, for example, a plunger pump, a diaphragm pump and a gear pump, and preferably they can supply a dilution solvent quantitatively. The solvent tank 6 may be a cartridge type of tank, just like the pressure tank 2, and it may be constructed so that it allows the dilution solvent to be pressurized by compressed air and fed under the pressure if necessary. When an additive such as a curing agent is supplied, a separate tank may be provided and connected to the manifold 10.

The manifold 10 is connected to a mixing machine 11 and the coating material and the dilution solvent having been supplied to the manifold 10 are mixed/dispersed uniformly in the mixing machine 11 and adjusted to give a suitable viscosity for coating. The adjusted coating material is supplied to a coating machine 14 such as a spray gun type or a rotary bell type.

Figure 3:
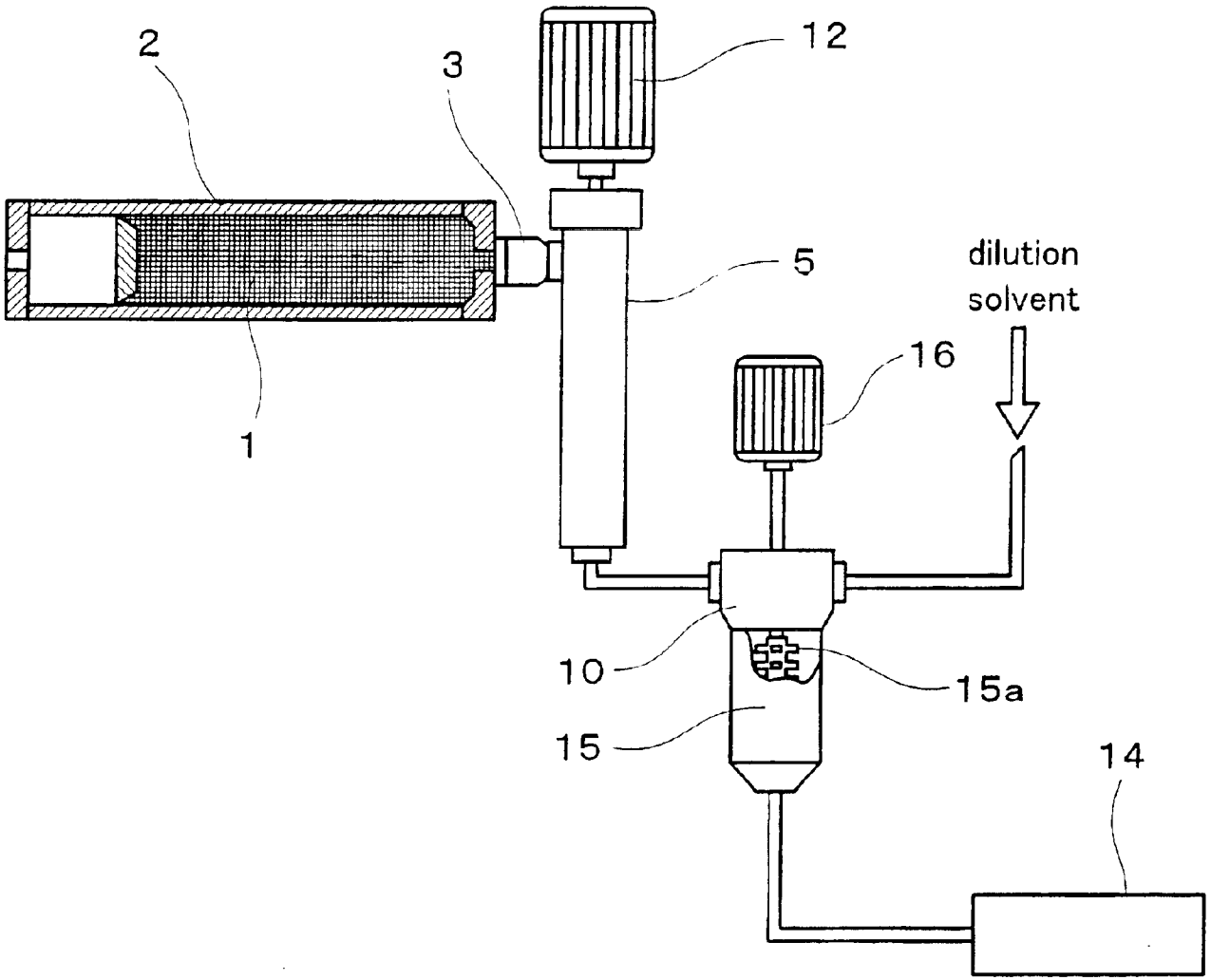
FIG. 3 is a cross-sectional view showing a variation of the mixing machine of the apparatus for supplying a coating material shown in FIG. 1.

As the mixing machine 11, a static mixer is used in this embodiment; however, when the coating material is required to be atomized and have a decreased viscosity, a power mixer 15 can be used which is capable of stirring and mixing the coating material with a screw-like movable element 15*a* rotationally driven by a motor 16, as shown in FIG. 3. Particularly when using a high-solids-content two component coating material (solids content of 70 to 100%) (more preferably when using a high-solids-content two component urethane resin coating material), a power mixer can be preferably used and the mixed coating material is allowed to have viscosity sufficiently low for coating due to the frictional heat generated by the stirring and mixing. When using a powder slurry coating material, the powder in the slurry can be dispersed to primary particles with a power mixer.

Preferably, the length of the flow path from the mixing machine 11 to the injection opening of the coating machine 14 is not more than 20 to 30 cm so that the coating material should not be precipitated during the time of stopping spraying at the coating machine 14. If the length is more than 30 cm, it is preferable to form a cyclic route.

In the following a method will be described for supplying a coating material to a coating machine using the above described apparatus for supplying a coating material. The apparatus for supplying a coating material can be particularly preferably used when diluting a high-viscosity coating material to a suitable viscosity for coating and supplying the diluted coating material to a coating machine.

The high-viscosity coating materials herein used mean, for example, acrylic resin coating materials, polyester resin coating materials, urethane resin coating materials, epoxy resin coating materials, and melamine resin coating materials, of which viscosity is preferably about 1.5 to 30 Pa·s, more preferably about 2 to 30 Pa·s, and much more preferably about 3 to 25 Pa·s (measured with a cone plate shaped (type E) rotational viscometer). Both coating materials having too high viscosity and those having too low viscosity are not preferable, because the former is hard to supply even with the apparatus for supplying a coating material of this embodiment, whereas the latter allows the pigments contained therein to be precipitated easily.

The high-viscosity coating materials may be one component coating materials or two component coating materials in which a resin component as a chief component is mixed with a curing agent at the point of use. These coating materials may contain a body pigment, a coloring pigment and a glitter in addition to a resin component The high-viscosity coating materials can take the form of, for example, a solution, a dispersion, an emulsion, a paste or a slurry. The coating materials in the form of a slurry include those formed by mixing a powder coating material with a medium. The concentration of the solids content of a high-viscosity coating material is, for example, about 40 to 100%, though it varies depending on the form of the coating material and the kind of the resin contained in the coating material. In more particular, for the coating materials in the form of a powder slurry, the concentration of the solids content is about 40 to 50%, and for the coating materials in the form of a solution or a paste, the concentration of the solids content is about 70 to 100%.

As a dilution solvent, an organic solvent, water or the mixture thereof can be used depending on the coating material used, and if necessary, it may contain additives such as a dispersant. The dispersants applicable include, for example, a dispersing resin and a surfactant. When the high-viscosity coating material is a two component coating material, a curing agent is used in combination with a dilution solvent.

In this embodiment, first a high-viscosity coating material is filled into the pressure tank 2 and a dilution solvent is filled into the solvent tank 6. When using a two component coating material, a curing agent may be contained in the solvent tank 6 together with a dilution solvent, or a curing agent may be contained in a tank provided separately from the solvent tank 6 and the apparatus may be constructed so that it can supply the curing agent to manifold 10 though a flow path different from that of the dilution solvent.

At the time of supplying a coating material to the coating machine, first compressed air is allowed to act on the pressure tank 2 and at the same time the metering pump is actuated. The coating material pressed by the action of the compressed air in the pressure tank 2 is extruded from the discharge opening 2*a*, and supplied to the manifold 10 with its flow rate having been quantified by the metering pump 5.

Preferably the pressure of the compressed air supplied to the pressure tank 2 at the time of supplying a coating material is, for example, about 1 to 2 MPa from the viewpoint of heightening the precision of the coating material flow rate, though it depends on the viscosity of the coating material or the discharge performance of the metering pump 5. If the pressure of the compressed air is too high, the coating material is likely to leak from the metering pump 5 and be discharged to excess. On the other hand, if the pressure of the compressed air is too low, cavitation occurs within the metering pump 5, which is likely to cause lack of the coating material flow rate.

Actuating the solvent pump 9 at the same time as supplying a coating material allows a dilution solvent to be supplied from the solvent tank 6 to the manifold 10 at constant flow rate. The coating material and the dilution solvent having been supplied to the manifold 10 are mixed in the mixing machine 11 and then supplied to the coating machine 14, and the coating material mixture is sprayed from the coating machine 14 toward the object to be coated. To accelerate the atomization of the coating material mixture sprayed, ultrasonic vibration can be provided to the coating material supplied within the coating material supply flow path from the mixing machine 11 to the coating machine or within the coating machine 14.

As described so far, according to the apparatus for supplying a coating material of this embodiment, a high-viscosity coating material can be fed under the pressure of compressed air and supplied to a mixing machine with its flow rate having been quantified with a metering pump. Accordingly, even a high-viscosity coating material can be reliably supplied to a coating machine, and even a coating material such as a powder slurry which becomes susceptible to precipitation of solids content when being diluted to a suitable viscosity for coating can be adjusted to a desired viscosity without causing a problem of solid-liquid separation.

In the following this invention will be described in detail giving a few examples. In the apparatus for supplying a coating material shown in FIG. 1, a coating material in the form of a powder slurry with a solids content of 45% and a viscosity of 3 Pa·s was filled into a pressure tank 2 and a water solvent was filled into a solvent tank 6, and the coating material mixture was supplied to a coating gun. As a result of this, the coating material mixture with a solids content of 35% could be supplied to a spray coating gun without causing a problem of solid-liquid separation and applied to the object to be coated satisfactorily.

A high-solids-content clear main agent with a viscosity of 26 Pa·s was filled into a pressure tank 2 and a curing agent with a viscosity of 2.5 Pa·s was filled into a solvent tank 6, and the coating material mixtures were supplied to a rotary bell type coating machine. As a result of this, the coating material mixture with a mixed viscosity of about 5 Pa·s could be supplied to a rotary bell type coating machine and applied to the object to be coated satisfactorily.

What is claimed is:

1. A method for supplying a coating material, comprising a step of supplying a high-viscosity coating material from a coating material tank to a mixing machine;

a step of supplying a dilution solvent from a solvent tank to the mixing machine; and a step of mixing the high-viscosity coating material and the dilution solvent in the mixing machine to supply the mixture to a coating machine, wherein the step of supplying a high-viscosity coating material to a mixing machine comprises a step of supplying the high-viscosity coating material from the coating material tank under the pressure of compressed air continuously to a metering pump to quantify the flow rate of the high-viscosity coating material and supply the material to the mixing machine.

2. The method for supplying a coating material according to claim 1, wherein the viscosity of the high-viscosity coating materials is about 1.5 to 30 Pa·s.

3. The method for supplying a coating material according to claim 1, wherein the pressure of the compressed air supplied to the coating material tank at the time of supplying a coating material is about 1 to 2 MPa.

4. An apparatus for supplying a coating material, comprising a coating material tank for storing a high-viscosity coating material;

a solvent tank for storing a dilution solvent;

a mixing machine for mixing the high-viscosity coating material and the dilution solvent;

a metering pump for supplying the high-viscosity coating material from the coating material tank to the mixing machine; and a solvent pump for supplying the dilution solvent from the solvent tank to the mixing machine, wherein the coating material tank is a pressure tank which allows the high-viscosity coating material to be fed under the pressure of compressed air and the metering pump supplies the high-viscosity coating material fed continuously from the coating material tank under the pressure of compressed air to the mixing machine while quantifying the flow rate of the same.

5. The apparatus for supplying a coating material according to claim 4, wherein the coating material tank is constructed to have a coating material tube removably installed therein and the coating material can be discharged by shrinking the coating material tube by the action of compressed air.

6. The apparatus for supplying a coating material according to claim 4, further comprising a coating machine connected to the mixing machine.

7. The apparatus for supplying a coating material according to claim 4, wherein the mixing machine is a power mixer.

* * * * *